US009284077B2

(12) United States Patent
Jones

(10) Patent No.: US 9,284,077 B2
(45) Date of Patent: Mar. 15, 2016

(54) METHODS AND APPARATUS FOR FILLING A CONTAINER WITH A POUCH AND A FLOWABLE FOOD PRODUCT

(75) Inventor: Robert C Jones, Aurora, IL (US)

(73) Assignee: Kraft Foods Group Brands LLC, Northfield, IL (US)

( * ) Notice: Subject to any disclaimer, the term of this patent is extended or adjusted under 35 U.S.C. 154(b) by 1253 days.

(21) Appl. No.: 12/750,081

(22) Filed: Mar. 30, 2010

(65) Prior Publication Data

US 2011/0239595 A1 Oct. 6, 2011

(51) Int. Cl.

| | |
|---|---|
| ***B65B 1/04*** | (2006.01) |
| ***B65B 3/04*** | (2006.01) |
| ***B65B 61/20*** | (2006.01) |
| ***B65B 5/04*** | (2006.01) |
| ***B65B 1/06*** | (2006.01) |
| ***B65B 1/22*** | (2006.01) |
| ***B65B 39/00*** | (2006.01) |
| ***B65B 43/52*** | (2006.01) |
| *B65B 7/20* | (2006.01) |

(52) U.S. Cl.

CPC ... *B65B 5/04* (2013.01); *B65B 1/06* (2013.01); *B65B 1/22* (2013.01); *B65B 39/007* (2013.01); *B65B 43/52* (2013.01); *B65B 61/20* (2013.01); *B65B 7/20* (2013.01)

(58) Field of Classification Search

CPC ..... B65B 29/10; B65B 5/061; B65B 5/101; B65D 81/3261; B65D 31/12; B65D 77/24; B65D 85/1081

USPC ..... 53/238, 239, 240, 474; 141/164, 166, 141/168, 171, 377

See application file for complete search history.

(56) References Cited

U.S. PATENT DOCUMENTS

| | | | | |
|---|---|---|---|---|
| 2,896,384 | A * | 7/1959 | Carlsen et al. | 53/502 |
| 4,428,175 | A * | 1/1984 | Haab | 53/55 |
| 4,600,065 | A * | 7/1986 | Morris | 177/123 |
| 4,608,808 | A | 9/1986 | Ryan et al. | |
| 4,905,456 | A * | 3/1990 | Olaechea | 53/446 |
| 5,058,634 | A | 10/1991 | Tisma | |
| 5,159,796 | A * | 11/1992 | Tas | 53/245 |
| 5,502,949 | A * | 4/1996 | Main et al. | 53/448 |
| 5,611,193 | A | 3/1997 | Farrelly | |
| 5,765,337 | A | 6/1998 | Lodewegen et al. | |
| 5,778,640 | A | 7/1998 | Prakken et al. | |
| 5,855,105 | A | 1/1999 | Ferris | |
| 6,322,316 | B1 * | 11/2001 | Hart et al. | 414/798.6 |
| 6,574,943 | B2 * | 6/2003 | Van Dam | 53/447 |
| 6,668,522 | B2 * | 12/2003 | Prakken | 53/437 |

(Continued)

*Primary Examiner* — Stephen F Gerrity
*Assistant Examiner* — Eyamindae Jallow
(74) *Attorney, Agent, or Firm* — Fitch, Even, Tabin & Flannery LLP

(57) ABSTRACT

Methods and apparatus for tilting and filling a carton with a pouch and a flowable food product are described. The carton can be tilted prior to filling in order to minimize a void between the pouch and a sidewall of the carton. The carton is pivoted to a tilted orientation, such that the sidewall includes a lowermost inclined segment. The pouch is then inserted into the carton either prior to or after pivoting the carton to the tilted orientation so that the pouch can substantially rest against the inclined segment. The flowable food product is then at partially deposited into the carton, such that the flowable food product substantially fills in next to the pouch instead of between the pouch and the inclined segment. After a sufficient height of flowable food product has been deposited into the carton, the carton can be returned to a vertical orientation and closed.

28 Claims, 4 Drawing Sheets

(56) References Cited

U.S. PATENT DOCUMENTS

| | | | | |
|---|---|---|---|---|
| 6,722,108 | B1 | 4/2004 | Kotsiopoulos | |
| 6,739,111 | B2 * | 5/2004 | Banks et al. | 53/415 |
| 7,137,234 | B2 | 11/2006 | Caporali et al. | |
| 7,178,313 | B2 * | 2/2007 | Bezek et al. | 53/445 |
| 7,458,195 | B2 * | 12/2008 | Bezek et al. | 53/445 |
| 7,856,797 | B2 * | 12/2010 | Black et al. | 53/447 |
| 2003/0213707 | A1 * | 11/2003 | Clay | 206/217 |
| 2004/0098948 | A1 | 5/2004 | Caporali et al. | |

* cited by examiner

METHODS AND APPARATUS FOR FILLING A CONTAINER WITH A POUCH AND A FLOWABLE FOOD PRODUCT

FIELD

This disclosure relates to filling a container and, in particular, to filling a container with a pouch and a flowable food product.

BACKGROUND

One type of container used for food products includes a carton enclosing both a pouch containing a food product and a loose, solid, flowable food product, such as dried pasta. One method of packaging involves inserting the pouch into the carton first and then subsequently depositing the flowable food product into the carton to at least partially fill the carton.

One issue that can result from this sequence is that before the flowable food product is deposited into the carton, the pouch shifts, falls, or otherwise ends up in a position where it lies across an interior of the carton with a bottom end abutting one sidewall at a bottom corner of the carton and a top end of the pouch abutting an opposite side wall at a location spaced from a bottom wall of the carton. If the pouch is of sufficient size, this positioning can at least partially block off a bottom corner region of the carton. This can disadvantageously prevent the flowable food product from flowing into the corner region. If a sufficient volume is blocked by the pouch, the carton can overfill with the flowable food product, which may result in the flowable food product spilling onto the floor or otherwise wasting the flowable food product, as well as creating additional work to clean up the overfilled product that did not go into the carton. Simply increasing the size of the carton is not a desirable solution, as providing excess headspace in the carton to accommodate for the inaccessible volume of the corner region can increase packaging costs. Yet another problem can arise when quality control standards require that the improperly filled container be rejected, which wastes the food products and the packaging for the container and the pouch. Another problem is that a carton having a blocked corner region can have a different center of gravity than cartons where the pouch is largely against only one of the sidewalls, which can result in a less stable carton. This lesser stability can be exacerbated when the carton has a height that is greater than the width and/or depth of the base.

As disclosed in U.S. Pat. No. 5,058,634, a packaging machine can tip a box being filling with a light and fluffy particulate product to provide a vent for air, which can otherwise become entrapped by the particulate product. This allows the product to roll down the inclined side of the box, rather than fall in a straight drop. This process, however, does not address the problems presented by combining a pouch and a flowable food product in a container.

U.S. Pat. No. 4,608,808 discloses utilizing a horizontal conveyor and a flat guiding plate to pack flexible bags into a container which is held at an angle. This disclosure, however, is limited to products contained within the flexible bags. U.S. Pat. No. 5,855,105 discloses utilizing a horizontal conveyor to deposit pouches into a container held at an angle in a continuous process. The container is moved so that a next empty space of the container is aligned with the subsequent pouch. These patents describe methods to fully pack a container with bags or pouches and do not address the problems presented by filling the containers with a flowable food product alongside the bags or pouches.

SUMMARY

Methods and apparatus are provided that maximize the occurrence of pouches that rest largely against only one sidewall of the container prior to the flowable food product filling the container such that the any blocked volume in the bottom region of the carton is minimized.

In one form a method is provided to place an insert and a flowable food product into a container. The container is provided with a closed bottom and an upstanding sidewall, which define an interior accessible through an open top. The container is then moved to a tilted or inclined orientation to create an inclined segment of the sidewall. A generally planar insert is placed into the interior of the container either before or after the container is pivoted to the tilted orientation. This allows the insert to substantially rest against the inclined segment of the sidewall. The interior of the container is then at least partially filled with a flowable food product while the container is in the tilted orientation. This configuration advantageously ensures that the insert lays against the inclined segment while the container is being filled, so that the insert substantially does not block a bottom region of the container from being filled by the flowable food product.

In another form, a method is provided to insert a pouch and a flowable food product into a carton. The carton is provided with a bottom wall, an upstanding sidewall having at least one generally planar segment, and an open top. The carton is moved to a tilted orientation such that at least a portion of the generally planar segment of the sidewall is the lowermost portion of the sidewall. A pouch is inserted into the carton either before or after the carton is pivoted to the tilted orientation. The tilted orientation of the carton guides the pouch to the lowermost portion of the sidewall, such that the pouch substantially rests against the generally planar segment of the sidewall. Substantially resting against the generally planar segment of the sidewall minimizes any void between the pouch and the sidewall so that as the flowable food product is subsequently at least partially deposited into the carton in the tilted orientation, any voids that are not filled are also advantageously minimized.

In yet another form, an apparatus is provided to insert a pouch into a container and at least partially fill the container with a flowable food product. The apparatus includes a tilting station that is configured to move a container to an inclined orientation. A pouch insertion station is configured to insert a pouch into a container either before or after the container is pivoted to the inclined orientation. The inclined orientation of the container presents an inner surface of a sidewall of the container as its lowermost point, which the pouch is then advantageously and naturally disposed to. settle against after insertion. The pouch rests against the inner surface such that empty space between the pouch and the inner surface is minimized. A filling station is configured to at least partially fill a container with a flowable food product while the container is in the inclined orientation and the pouch rests against an inner surface of a sidewall of the container. At least one conveyor is provided for transporting a container from the tilting station to the pouch insertion station and from the pouch insertion station to the filling station. This apparatus advantageously deposits both a pouch and a flowable food product into containers while also ensuring consistent fill levels in the containers by minimizing the occurrence of the blocked regions in the containers, such as when the pouch blocks a bottom region of the container.

DETAILED DESCRIPTION

Methods and apparatus for tilting and filling a carton will be described with reference to FIGS. 1-7. The carton can be tilted prior to filling in order to ensure a proper filling combination of a pouch and a flowable food product. In a properly filled carton, the pouch rests against a sidewall of the carton and the flowable food product fills in next to the pouch and the remaining sidewalls of the carton. In order to achieve this result in a uniform fashion, the method and apparatus described herein tilts the carton, inserts the pouch into the carton either before or after the carton is pivoted to the tilted orientation so that the pouch rests against an inclined segment of the sidewall, and at least partially fills the carton with the flowable food product such that the flowable food product does not fill between the pouch and the inclined segment of the sidewall. The methods and apparatus described herein have particular applicability in a high speed commercial production setting where production rates and quality control are important.

Figure 8:
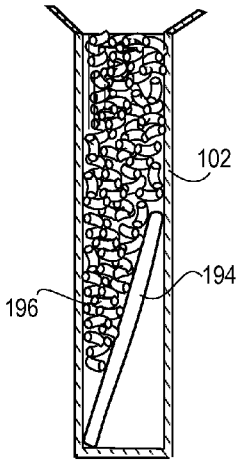
FIG. 8 is a sectional view of a prior art carton showing a pouch blocking a portion of the carton from filling.

As described in detail below, the carton is fed through a process to deposit the pouch and the flowable food product into the carton while minimizing a void between the pouch and the sidewall of the carton. The carton is pivoted or rotated to a tilted orientation, such that a sidewall of the carton includes a lowermost inclined segment. The pouch is deposited into the carton either before or after the carton is pivoted to the tilted orientation and the tilted orientation of the carton then maximizes the occurrence of the pouch resting substantially against the lowermost inclined segment of the sidewall. This positioning minimizes any void between the pouch and the sidewall, which can result from prior methods and apparatus such as shown in FIG. 8. The flowable food product is then at least partially deposited into the carton while the carton remains in the tilted orientation so that the pouch remains against the lowermost inclined segment of the sidewall. With the void minimized as discussed above, the flowable food product substantially fills in next to the pouch rather than between the pouch and the sidewall. The flowable food product can then be filled to a sufficient height as compared to the pouch, such that the pouch is held against the sidewall by the flowable food product. After this point, the carton can be returned to a vertical orientation and closed.

Figure 1:
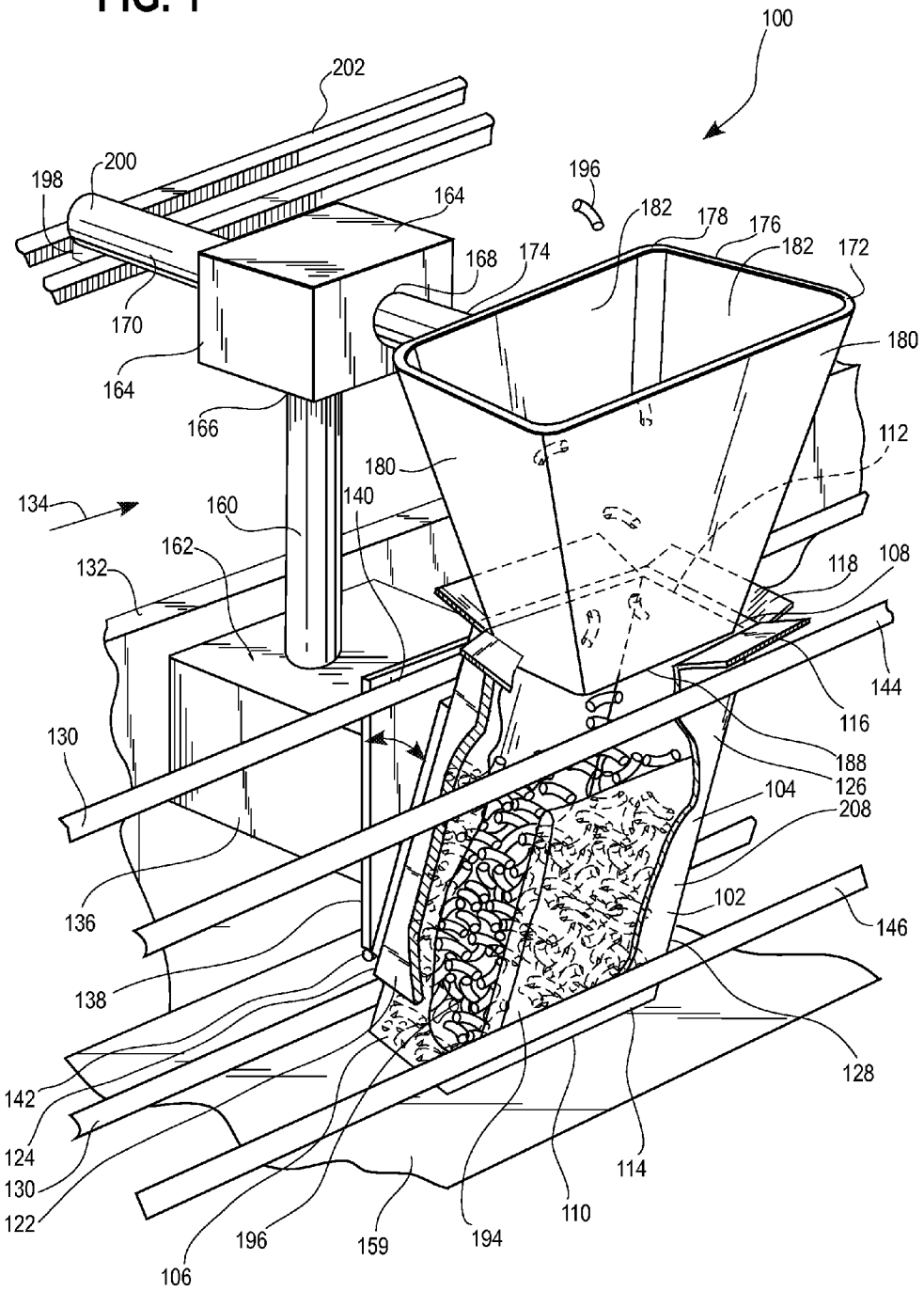
FIG. 1 is a schematic perspective view of a tilting apparatus showing a carton in a tilted orientation having a pouch therein and being at least partially filled with a flowable food product.

Referring now to FIG. 1, a tilting apparatus 100 is shown. A carton or container 102 of typical design and made from any suitable material, such as cardboard, plastic, metal, or the like, is provided. The carton 102 is preferably formed from a single blank of material and folded to create a generally tubular form, such as a rectangular tube with side walls 104 and end walls 106. The rectangular tube may be created, for example, by adhering a tab depending from one of the side walls 104 to an adjacent end wall 106 using any suitable adhesive or sealing process. When ready for filling, the carton 102 has a mouth 108 and a closed base 110 having associated top and bottom edges 112, 114 respectively.

The carton 102 is positioned within a three-sided carrier or conveyor compartment 120. The carrier 120 has end walls 122 connected by a side wall 124. The width of the side wall 124 of the carrier 120 can be sized to substantially match or be slightly larger than the width of the side walls 104 of the carton 102. The width of the end walls 122 of the carrier 120 can also be sized to generally match the width of the end walls 106 of the carton 102, but can also have a greater or smaller width as desired or required by a particular operation. The height of the end walls 122 and the side wall 124 are preferably sized to span an intermediate portion 125 of the carton 102, such as spaced from the top and bottom edges 112, 114 of the carton 102. This leaves top and bottom edge portions 126, 128 of the carton 102 exposed above and below the carrier 120 respectively. The top and bottom edge portions 126, 128 can then be utilized to control the location of the carton 102 through guide rails 130, discussed in more detail below.

The carrier 120 is attached to a conveyor 132, such as a chain or belt conveyor, to be driven thereby. Alternatively, a flighted chain conveyor could be utilized in place of the carrier 120 described above. As the carrier 120 is driven by the conveyor 132, the carrier 120 in turn drives movement of the carton 102 in a feed or downstream machine direction, such as indicated by arrow 134, however, the shape of the carrier 120 being front loaded allows the carrier 120 to function similarly in either feed direction.

Specifically, the carrier 120 is spaced from and connected to the conveyor 132 by a conveyor attachment 136 and a hinged connector 138. The conveyor attachment 136 connects to the conveyor 132 to be driven thereby, while the hinged connector 138 connects the conveyor attachment 136 to the carrier 120. The hinged connector 138 includes plates 140 of any suitable material, such as metal, plastic, or the like, pivotably connected by a hinge 142. The plates 140 are attached to the conveyor attachment 136 and/or the carrier 120 respectively by any suitable mechanism or method, such as adhesive, welding, hardware, tongue-and-groove, snap fit, or the like. Alternatively, the carrier 120 and/or the conveyor attachment 136 can be directly attached to the hinge 142 without the use of the plate 140. Preferably, the plate 140 connected to the carrier 120 does not project above the side wall 124 of the carrier 120, however, the plates 140 can extend above the side wall 124 of the carrier 120 as long as the plates 140 do not interfere with the operation of the guide rails 130, discussed in more detail below. In yet another form, the carrier 120 may be directly attached to the conveyor 132, such as by the conveyor attachment 136. The conveyor 132 can then turn inwardly at an angle to drive the carrier 120 to a tilted orientation and hold the carrier 120 in the tilted orientation until the conveyor 132 is returned to a vertical orientation, which will also return the carrier 120 to the vertical orientation.

Figure 2:
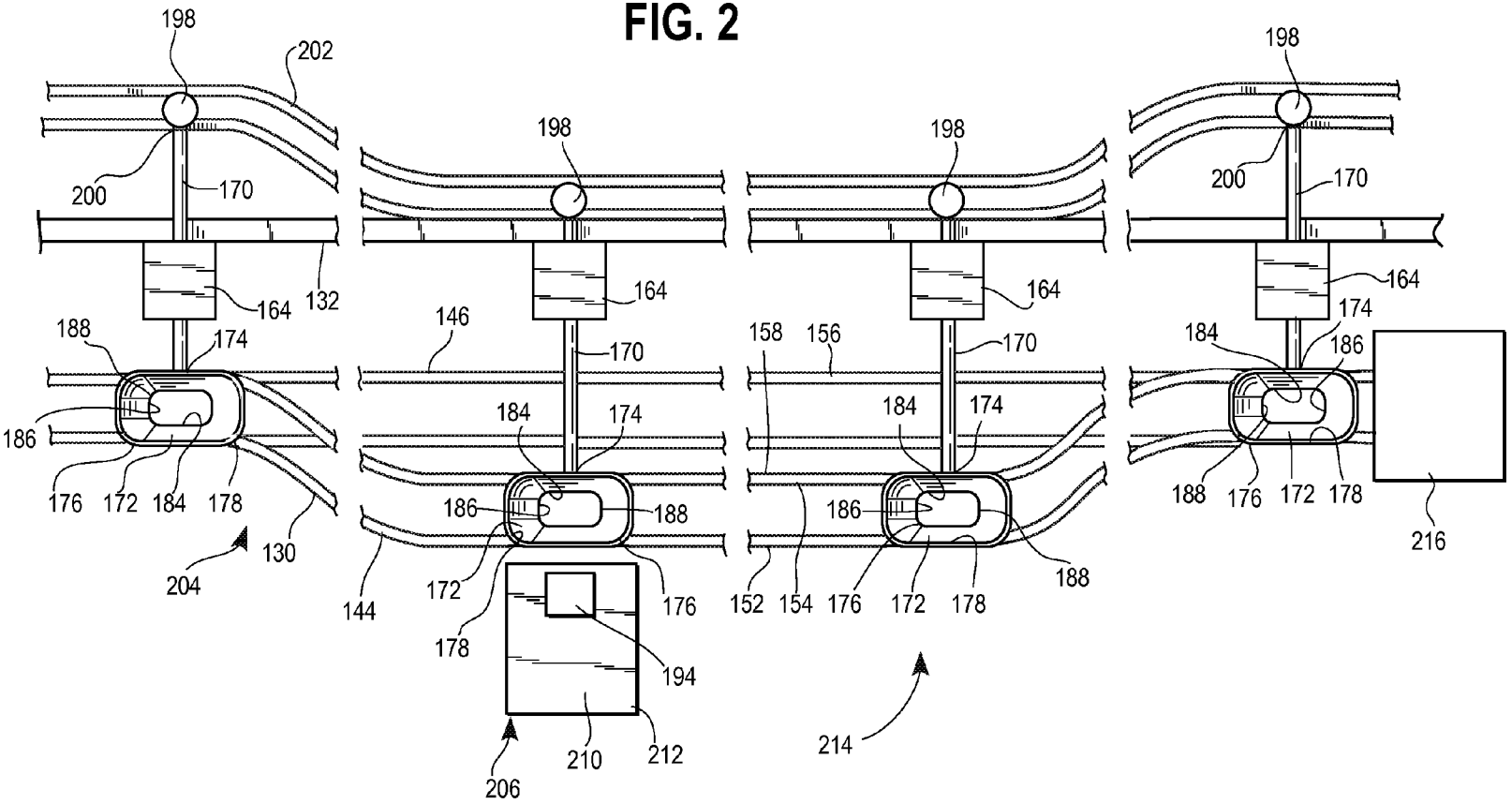
FIG. 2 is a top plan view of the tilting apparatus of FIG. 1 showing transitions of a funnel using cam track and guide rails from a generally vertical orientation to a tilted orientation and back to the generally vertical orientation.

As illustrated, the guide rails 130 include top and bottom guide rails 144, 146 positioned adjacent the side walls 104 of the carton 102. Specifically, the top guide, rails 144 are positioned adjacent top edge portions 126 of the side walls 104 of the carton 102 and the bottom guide rails 146 are positioned adjacent bottom edge portions 128 of the sidewalls 104 of the carton 102. The guide rails 130 are illustrated with a generally rectangular cross section, but other suitable cross-sectional shapes could also be utilized, such as generally circular, oval, or other regular or irregular polygons. The top and bottom guide rails 144, 146 are configured to control lateral movement of the carton 102, and specifically, to control lateral movement of the mouth 108 and the base 110 of the carton 102 separately. By one approach, the guide rails 130 transition from a first position restricting the carton 102 to a generally vertical orientation, to a second position holding the carton 102 in a tilted orientation, to a third position restricting the carton 102 to the generally vertical orientation, as best illustrated in FIG. 2. The tilted orientation may correspond to the carton 102 being held at an angle in the range of 30 degrees to 85 degrees, and preferably 45 degrees. As the top guide rails 144 transition from the first position to the second position, the top guide rails 144 extend outward and slightly downward, with an outer top guide rail 152 positioned slightly lower than an inner top guide rail 154, such that the inner and outer top guide rails 152, 154 stay positioned adjacent the top edge portion 126 of the carton 102. The top guide rails 144 as viewed from a vertical cross-section may maintain a generally vertical orientation as the top guide rails 144 transition and maintain in the second position. Alternatively, the top guide rails 144 as viewed from a vertical cross-section can also angle or rotate to accommodate or substantially match the angle of the carton 102 in the tilted orientation, so as to provide a greater contact area between the top guide rails 144 and the carton 102. As illustrated, the base 110 of the carton 102 is tilted, but generally maintains its lateral position. Accordingly, the bottom guide rails 146 do not substantially transition laterally. Instead, an inner bottom guide rail 156 extends slightly upward to accommodate the tilt of the base 110 of the carton 102 and an outer bottom guide rail 158 substantially maintains its position. So positioned, the inner and outer bottom guide rails 156, 158 maintain a position adjacent the bottom edge portions 128 of the carton 102. As stated above with respect to the top guide rails 144, the bottom guide rails 146 as viewed from a vertical cross-section can also angle or rotate to accommodate or substantially match the angle of the carton 102 in the tilted orientation.

The guiderails 130 have been described as utilizing a pair of guiderails, however, a single guiderail could be configured to operate in a similar manner, such as in conjunction with a groove, or the cam track 202 its associated structure, as discussed below, could be utilized to tilt the carton 102 and/or hold the carton 102 in the tilted orientation.

The base 110 of the carton 102 rests on a support rail 159 positioned adjacent the conveyor 132. The support rail 159 is configured to support the carton 102 during the tilting, filling, and/or closing processes as described herein. By one approach, the support rail 159 is separate from the conveyor 132, instead positioned along a length of the conveyor 132 to slidably support the carton 102. By another approach, the support rail 159 may be attached to the conveyor and segmented to individually support the cartons 102 driven by the conveyor. As illustrated, the support rail 159 maintains a level orientation regardless of the orientation of the carton 102, however, the support rail 159 could also be configured to tilt or incline, such as to an angle to substantially match the incline of the base 110 of the carton 102, to provide support for the carton 102 in the tilted orientation. In one form, the support rail 159 may further include vibration capabilities, such as by a washboard rail, a pneumatic vibrator, or the like, in order to settle any product deposited into the carton 102 while the carton 102 is being at least partially supported by the support rail 159.

A spacer 160 projects vertically from a top surface 162 of the conveyor attachment 136. A slide compartment 164 rests on a top distal edge 166 of the spacer 160. The slide compartment 164 includes a bore, tunnel, or cut-out portion 168 extending therethrough and is configured to slidably support a cam shaft 170 therethrough. As shown, the slide compartment 164 is generally boxed shaped, however, any suitable shape can also be utilized. A funnel 172 is attached to one end portion 174 of the cam shaft 170 to be utilized to fill the carton 102, such as with a random or volumetric fill process. As illustrated, a top shoulder surface 176 of the funnel 172 defines a top mouth 178 and is generally rectangular with rounded corners, however, non-rounded corners and/or other suitable shapes could be utilized, such as generally triangular, circular, oval, or other regular or irregular polygon, or other curvilinear shapes. The funnel 172, as illustrated, includes inwardly angled side walls 180 and generally vertical end walls 182 extending therebetween. Lower side edges 184 of the side walls 180 and lower end edges 186 of the end walls 182 form a bottom mouth 188.

In one form, the height of side walls 180 and the end walls 182 of the funnel 172 is sized so that the bottom mouth 188 of the funnel 172 extends partially into the mouth 108 of the carton 102 or is generally even with one of the top edges 112 of the carton 102. The bottom mouth 188 is generally rectangular with rounded corners, as described above with respect to the top mouth 178. In one form, the bottom mouth 188 of the funnel 172 is sized such that a pouch or insert 194, described in more detail below, can pass therethrough. Additionally or in a different form, the bottom mouth 188 of the funnel 172 is sized such that a flowable food product 196, such as dried pasta, can pass therethrough. Accordingly, in these forms the lower side edge 184 and the lower end edges 186 of the bottom mouth 188 are spaced apart such that pouch 194 and the flowable food product 196 can pass therethrough without significant obstruction.

A cam 198 is attached to an other end portion 200 of the cam shaft 170. The cam 198 is slidably housed at least partially within a cam track 202 positioned adjacent the slide compartment 164. The cam 198 can be composed of any suitable material, such as plastic or metal, and can take any suitable shape that can slide and be at least partially housed within the cam track 202. In one form, the cam track 202 has a C-shaped vertical cross section with the opening of the C-shape facing the slide compartment 164. The cam shaft 170 extends into the cam track 202 and attaches to the cam 198, which is housed within and guided by the cam track 202. So configured, the cam track 202 guides the lateral position of the funnel 172 as the conveyor 132 drives the tilting apparatus 100 by guiding the cam 198 and therefore the cam shaft 170 and the funnel 172. As illustrated in FIG. 2, the cam track 202 transitions between a left position where the funnel 172 is substantially vertically aligned above the mouth 108 of the carton 102 when the carton 102 is in the generally vertical orientation and a right position wherein the funnel 172 is substantially vertically aligned above the mouth 108 of the carton 102 when the carton 102 is in the tilted orientation. Additionally, the cam track 202 is configured to laterally move the funnel 172 so that the funnel 172 substantially stays vertically aligned above the mouth 108 of the carton 102 as the carton is transitioned to the tilted orientation and transitioned to the generally vertical orientation.

By one approach, the pouch or insert 194 refers generally to a pouch or insert that if inserted into a vertically oriented carton is capable of blocking a portion of the carton from filling with the flowable food product, such as shown in FIG. 8. By another approach, the pouch 194 is generally planar, such that it has a thickness that is substantially less than its height or width, where the thickness does not have to be uniform, such as bulging slightly outward. In one example, the pouch 194 is generally rectangular and made from a single web of material with one edge portion folded over and the other three edge portions sealed by any suitable method, such as cold sealing, hot sealing, induction sealing, or the like. In another example, the pouch 194 is generally rectangular and made from two webs of material with all four edge portions sealed by any suitable method.

By one approach, a tilting station 204 is configured to move the carton 102 to the tilted orientation and can include the guide rails 130, the carrier 120, the conveyor attachment 136, and the hinged connector 138. A pouch insertion station 206 is configured to insert the pouch 194 into the carton 102 either before or after the carton 102 is pivoted to the tilted orientation and can include the funnel 172, the cam shaft 170, the cam 198, and the cam track 202, supported by the conveyor attachment 136, the spacer 160, and the slide compartment 164. When the carton 102 is in the tilted orientation, the pouch 194 can then come to substantially rest against an inclined, generally planar segment 208 of the sidewall 104 of the carton 102 that is lower than the other sidewall 104 because the carton 102 is in the tilted orientation. In the illustrated form, the carton 102 is in the tilted orientation as the pouch 194 is deposited into the carton 102, so that the pouch 194 comes to rest against the segment 208 of the sidewall 104. In another form, the pouch 194 is deposited into the carton 102 while the carton 102 is in the vertical orientation and the carton 102 with the pouch 194 therein is pivoted to the tilted orientation. Once the carton 102 is tilted in this form, the support rail 159 may vibrate, as discussed above, to maximize the occurrence of the pouch 194 resting against the segment 208 of the sidewall 104.

So configured, the pouch 194 rests against the inclined segment 208 of the sidewall 104 and minimizes any void between the pouch 194 and the inclined segment 208. In one form, the pouch insertion station 206 also includes a tilt tray mechanism 210. The tilt tray mechanism 210 includes a support surface 212 positioned adjacent the top mouth 178 of the funnel and is configured to tilt the support surface 212 so that the pouch 194 positioned thereon slides into the funnel 172, and through the funnel 172 into the carton 102. The pouch 194 can be deposited onto the support surface 212 using a horizontal conveyor or the like. In another form, the pouch insertion station 206 is configured to travel along adjacent to the carton 102 and the carrier 120 as the carton 102 and the carrier 120 are driven by the conveyor 132. A filling station 214 is configured to at least partially fill the carton 102 with the flowable food product 196 while the carton 102 is in the tilted orientation and can include the funnel 172, the cam shaft 170, the cam 198, and the cam track 202, supported by the conveyor attachment 136, the spacer 160, and the slide compartment 164. The filling station 214 volumetrically fills the carton 102 with a predetermined amount of flowable food product 196 from the funnel 172. A closing station 216 is positioned downstream of the tilting station 204, the pouch insertion station 206, and the filling station 214. The closing station 216 is configured to close the mouth 108 with side and end tabs 116, 118 that project from the top edge 112 after the pouch 194 and the flowable food product 196 has been deposited into the carton 102. So configured, when the carton 102 is positioned within the carrier 120 between the guide rails 130, the conveyor 132 is configured to transport the carton 102 from the tilting station 204 to the pouch insertion station 206 and from the pouch insertion station 206 to the filling station 214.

In one example, the carton 102 has a height of about 7.125 inches, the side walls 104 of the carton 102 have a width of about 3.5 inches, and the end walls 106 of the carton 102 have a width of 1.375 inches. The pouch 194 has a width of 3.125 inches, a height of 5.75 inches and a variable depth with a maximum of about 0.5 inch. The flowable food product 196 is dried pasta with a typical depth of about 0.125 inches to 0.25 inches. Accordingly, in this example, the side edges 190 of the bottom mouth 188 of the funnel 172 can be in the range of about 3.25 inches to 3.375 and the end edges 192 can be in range of about 0.625 inch to 1.25 inches in order to accommodate the pouch 194 and the flowable food product 196.

Figure 3:
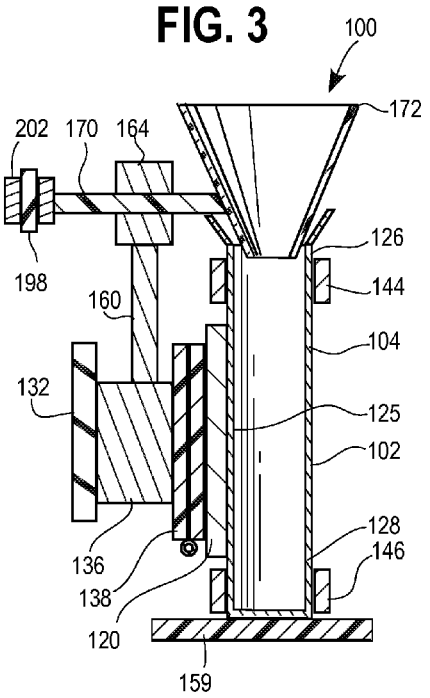
FIG. 3 is a sectional view of the tilting apparatus of FIG. 1 showing a first stage with the carton in a generally vertical orientation.

The steps of an example process are illustrated in FIGS. 3-7. In a first stage, as illustrated in FIG. 3, the carton 102 is supported by the support rail 159, the carrier 120, and the guide rails 130 in the generally vertical orientation. The funnel 172 is positioned above the mouth 108 of the carton 102 with the cam track 202 in the left position.

Figure 4:
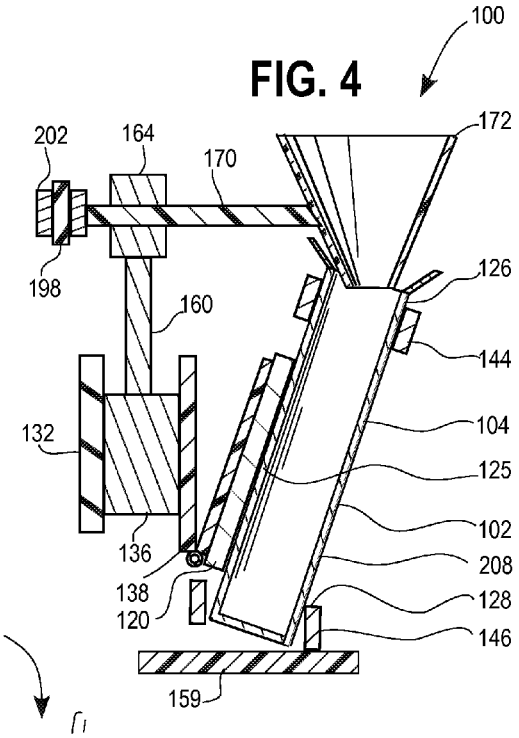
FIG. 4 is a sectional view of the tilting apparatus of FIG. 1 showing a second stage with the carton in a tilted orientation.

In a second stage, as illustrated in FIG. 4, the carton 102 has been pivoted or rotated to the tilted orientation by the guide rails 130. The carrier 120 has pivoted or rotated about the hinge 142 of the hinged connector 138 to maintain its positioning around the carton 102. The base 110 of the carton 102 is at least partially contacting the support rail 159 to be at least partially supported thereby. The funnel 172 is positioned above the mouth 108 of the carton 102 with the cam track 202 in the right position which drove the cam 108, the cam shaft 170, and the funnel 172 away from the conveyor 132 to track the lateral movement of the mouth 108 of the carton 102.

Figure 5:
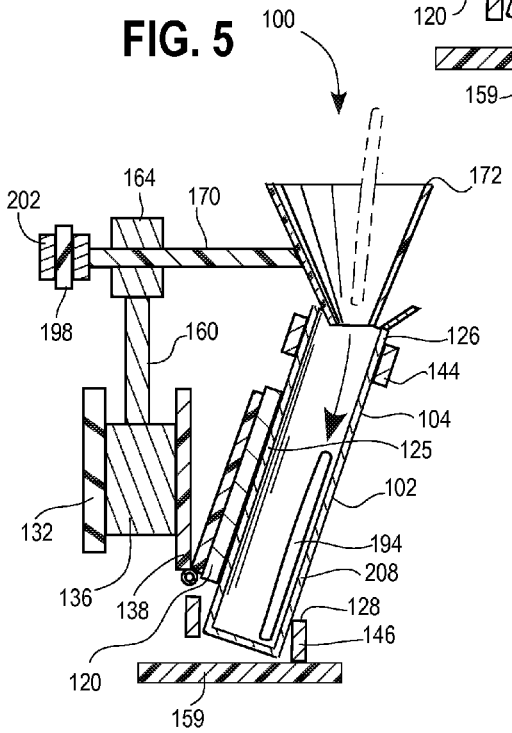
FIG. 5 is a sectional view of the tilting apparatus of FIG. 1 showing a third stage with the carton in a tilted orientation and a pouch being inserted into the carton and resting against an inclined segment of a sidewall of the carton.

In a third stage, as illustrated in FIG. 5, the pouch 194 is deposited into the carton 102, such as through the funnel 172. The carton 102 is either maintained in the tilted orientation as illustrated or is subsequently pivoted to the tilted orientation, as described above. The pouch 194 can be deposited into the carton 102 using the tilt tray mechanism 210. The pouch 194 slides into the funnel 172 and passes through the bottom mouth 188 of the funnel 172 into the carton 102. The pouch 194 travels to the base 110 of the carton 102, and because the carton 102 is in the tilted orientation, the pouch 194 is naturally biased to come to rest against the inclined, generally planar segment 208 of the sidewall 104 of the carton 102 that is lowermost of the two sidewalls 104, or in this form, the sidewall 104 positioned further away from the conveyor 132, due to the force of gravity and/or vibration by the support rail 159.

Figure 6:
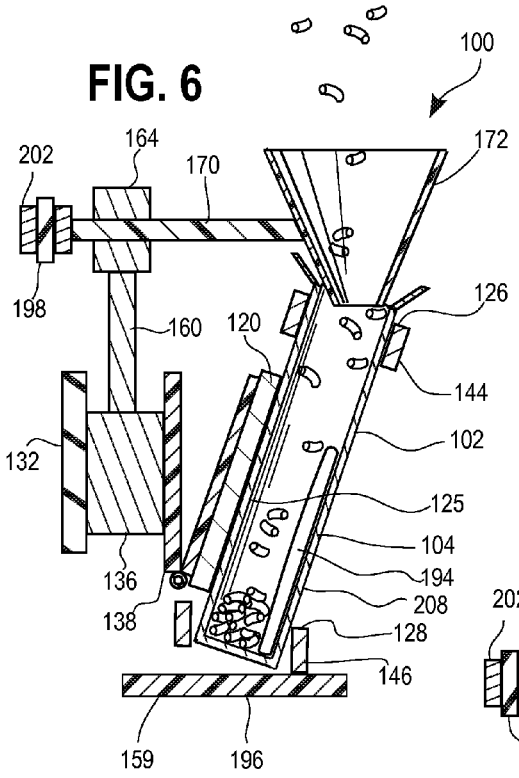
FIG. 6 is a sectional view of the tilting apparatus of FIG. 1 showing a fourth stage with the carton in a tilted orientation and being at least partially filled with a flowable food product.

In a fourth stage, as illustrated in FIG. 6, the flowable food product 196, illustrated as dried pasta, is at least partially deposited into the carton 102, such as through the funnel 172 with a volumetric or random fill. For at least a portion of the filling process of the flowable food product 196, the carton 102 is maintained in the tilted orientation. This ensures that the pouch 194 stays positioned against the inclined segment 208 of the sidewall 104 and that the flowable food product 196 will fill in next to the pouch 194 and substantially not fill in between the pouch 194 and the inclined segment 208 of the sidewall 104. By one approach, the support rail 159 may vibrate through this stage in order to maximize settling of the flowable food product 196. Eventually the flowable food product 196 fills in next to the pouch 194 to a sufficient level, such as about halfway up the height of the pouch 194, where the flowable food product 196 sufficiently holds the pouch 194 against the inclined segment 208 of the sidewall 104. Any time after this point, if desired, the carton 102 can be transitioned back to the generally vertical orientation. In such a case, the cam track 202 will shift to the left position so that the funnel 172 maintains a position aligned above the mouth 108 of the carton 102 and the flowable food product 196 can continue to at least partially fill the carton 102. Alternatively, the carton 102 can be filled to a desired level with the flowable food product 196 with the carton 102 entirely in the tilted orientation.

Figure 7:
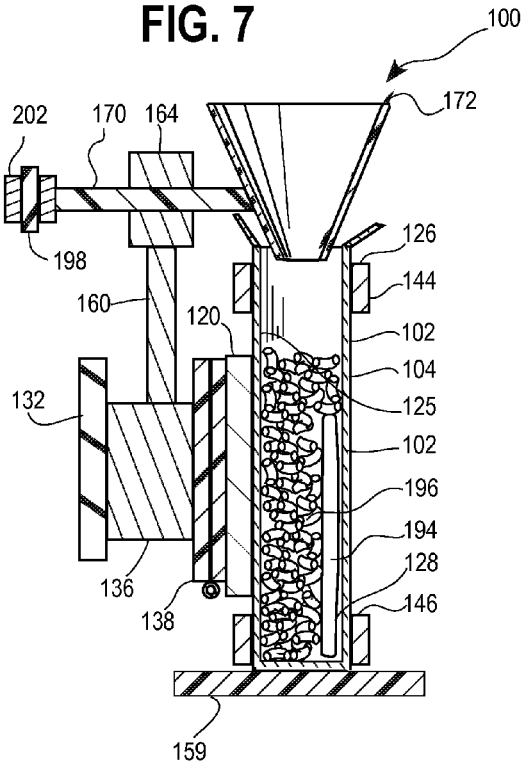
FIG. 7 is a sectional view of the tilting apparatus of FIG. 1 showing a fifth stage with the carton in the generally vertical orientation and filled with the pouch and the flowable food product.

In a fifth stage, as illustrated in FIG. 7, the carton 102 is back in the generally vertical orientation and is filled to a desired level with the flowable food product 196 and the pouch 194 is maintained in a position substantially adjacent the inclined segment 208 of the sidewall 104. As illustrated, any void created by positioning of the pouch 194 is minimized. The carton 102 can then be driven to the closing station 216 to close the mouth 108 of the carton 102 with the side tabs 116 and the end tabs 118, such as using a suitable adhesive, to seal the flowable food product 196 and the pouch 194 in the carton 102.

The drawings and the foregoing descriptions are not intended to represent the only forms of the separable raised platform in regards to the details of construction. Changes in form and in proportion of parts, as well as the substitution of equivalents, are contemplated as circumstances may suggest or render expedient.

The invention claimed is:

1. A method of placing an insert and a flowable food product into a container, the method comprising:

transporting a container in an upright orientation in a downstream direction with a conveyor, the container having a closed bottom with an upstanding sidewall defining an interior accessible through an open top;

moving the container from the upright orientation to a tilted orientation when the container is at a different position in the downstream direction so that there is an inclined segment of the sidewall;

placing a generally planar insert into the interior of the container either prior to or after the step of moving the container to the titled orientation so that the insert can substantially rest against the inclined segment of the sidewall; and at least partially filling the interior of the container with a flowable food product while the container is in the tilted orientation and after the step of placing the generally planar insert into the interior of the container.

2. The method of claim 1 wherein the step of placing the generally planar insert into the interior of the container is performed after the step of moving the container to the tilted orientation.

3. The method of claim 1 wherein the step of placing the generally planar insert into the interior of the container is performed prior to the step of moving the container to the tilted orientation and includes vibrating the container so that the insert can substantially rest against the inclined segment of the sidewall.

4. The method of claim 1 wherein the step of at least partially filling the interior of the container with a flowable food product includes at least partially filling the interior of the container with the flowable food product from a funnel configured to stay substantially aligned above the open top of the container while the container is moved.

5. The method of claim 1 wherein the step of placing a generally planar insert into the interior of the container comprises tilting a tray positioned adjacent the open top of the container and supporting the insert to allow the insert to slide into the interior of the container and rest against the inclined segment of the sidewall.

6. The method of claim 1 wherein the step of moving the container to a tilted orientation includes tilting the container generally outward by driving the container along at least one guide rail with a carrier coupled to the conveyor.

7. The method of claim 1 further comprising the step of moving the container to the upright orientation after the step of at least partially filling the interior of the container with a flowable food product.

8. The method of claim 1 further comprising the step of closing the open top of the container to seal the insert and the flowable food product within the container after the step of at least partially filling the interior of the container with a flowable food product.

9. The method of claim 1 wherein the downstream direction is generally horizontal.

10. The method of claim 1 wherein the step of at least partially filling the interior of the container with the flowable food product comprises at least partially filling the interior of the container so that the flowable food product abuts against the generally planar insert.

11. A method of inserting a pouch and a flowable food product into a carton, the method comprising:

transporting a carton in an upright orientation in a downstream direction with a conveyor, the container having a bottom wall, an upstanding sidewall having at least one generally planar segment, and an open top;

moving the carton from the upright orientation to a tilted orientation while the carton moves in the downstream direction so that the generally planar segment of the sidewall is the lowermost portion of the sidewall;

inserting a pouch into the carton either prior to or after the step of moving the container to the tilted orientation such that the pouch substantially rests against the generally planar segment of the sidewall to minimize any void between the pouch and the generally planar segment of the sidewall; and at least partially filling the carton with a flowable food product while the carton is in the tilted orientation and after the step of inserting the pouch into the carton.

12. The method of claim 11 wherein the step of inserting the pouch into the carton is performed after the step of moving the container to the tilted orientation.

13. The method of claim 11 wherein the step of inserting the pouch into the carton is performed prior to the step of moving the container to the tilted orientation and includes vibrating the carton so that the pouch substantially rests against the generally planar segment of the sidewall to minimize any void between the pouch and the generally planar segment of the sidewall.

14. The method of claim 11 wherein the step of at least partially filling the carton with a flowable food product further includes guiding a funnel configured to dispense the flowable food product outward to a position generally above the open top of the container in the tilted orientation.

15. The method of claim 11 wherein the step of at least partially filling the carton with a flowable food product comprises at least partially filling the carton with the flowable food product so that the flowable food product substantially does not fill between the pouch and the generally planar segment of the sidewall.

16. The method of claim 15 wherein the step of at least partially filling the carton with a flowable food product while the carton is in the tilted orientation further includes at least partially filling the carton with the flowable food product as the carton is moved from the tilted orientation to the generally vertical orientation, wherein at least some of the flowable food product at least partially holds the pouch against the generally planar segment of the sidewall.

17. The method of claim 11 further comprising the step of supporting at least a portion of a base of the carton with a support rail.

18. The method of claim 17 wherein the step of moving the carton to a tilted orientation includes guiding a top portion of the carton generally outward with at least one guide rail.

19. An apparatus for inserting a pouch into a container and at least partially filling the container with a flowable food product, the apparatus comprising:

a titling station configured to move a container to an inclined orientation;

a pouch insertion station configured to insert a pouch into a container either prior to or after the tilting station so that the pouch can rest against an inner surface of a sidewall of the container;

a filling station configured to at least partially fill a container with a flowable food product while the container is in an inclined orientation; and at least one horizontal conveyor for transporting a container between the titling station and the pouch insertion station and to the filling station.

20. The apparatus of claim 19 wherein the pouch insertion station is configured to insert a pouch into a container after the tilting station.

21. The apparatus of claim 19 wherein the pouch insertion station is configured to insert a pouch into a container prior to the tilting station and wherein the tilting station is further configured to vibrate the container so that the pouch can rest against the inner surface of the sidewall of the container.

22. The apparatus of claim 19 further comprising:

a pivotable carrier coupled to the horizontal conveyor for driving a container in a downstream machine direction while the container is fed through the tilting station, the pouch insertion station, and the filling station.

23. The apparatus of claim 19 wherein the horizontal conveyor further comprises a guide rail, wherein the guide rail is configured to move a container from a generally vertical orientation to the inclined orientation as the container advances in a downstream machine direction.

24. The apparatus of claim 19 wherein the filling station comprises a funnel coupled to a track by a cam, wherein the track guides the cam and the funnel outwardly so that the funnel is substantially aligned with a top of a container in the inclined orientation.

25. The apparatus of claim 19 further comprising a closing station downstream of the filling station configured to close an open top of a container to seal the food product and the pouch within the container.

26. The apparatus of claim 19 wherein the pouch is generally rectangular and configured to contain a second food product.

27. The apparatus of claim 19 wherein the pouch insertion station comprises a support surface adjacent an open top of a container and a tilting mechanism, the support surface configured to support the pouch and be tilted by the tilting mechanism to a position where the pouch slides into the container.

28. A method of placing an insert and a flowable food product into a container, the method comprising:

providing a container in an upright orientation, the container having a closed bottom with an upstanding sidewall defining an interior accessible through an open top;

placing a generally planar insert into the interior of the container;

moving the container from the upright orientation to a tilted orientation after the step of placing the generally planar insert into the interior of the container so that there is an inclined segment of the sidewall and the insert can substantially rest against the inclined segment of the sidewall; and at least partially filling the interior of the container with a flowable food product while the container is in the tilted orientation.

* * * * *